US005199782A

United States Patent [19]

Johnson et al.

[11] Patent Number: 5,199,782

[45] Date of Patent: Apr. 6, 1993

[54] ILLUMINATION SYSTEM FOR VANITY OR THE LIKE

[75] Inventors: Glenn M. Johnson, Westlake Village; David C. Breda, Hermosa Beach, both of Calif.

[73] Assignee: Glen Co. Breda & Associates, Inc., Westlake Village, Calif.

[21] Appl. No.: 822,993

[22] Filed: Jan. 21, 1992

Related U.S. Application Data

[63] Continuation-in-part of Ser. No. 704,878, May 23, 1991, abandoned.

[51] Int. Cl.[5] ..... F21S 1/02

[52] U.S. Cl. ..... 362/147; 362/135; 362/346; 362/365

[58] Field of Search ..... 362/135, 145, 147, 148, 362/217, 221, 249, 263, 297, 346, 364, 365, 341

[56] References Cited

U.S. PATENT DOCUMENTS

| | | | |
|---|---|---|---|
| 384,903 | 6/1888 | Francis | 362/135 |
| 1,900,436 | 5/1933 | Dourgnon . | |
| 2,082,687 | 6/1937 | Davis . | |
| 3,609,340 | 9/1971 | Habre | 240/41.1 |
| 3,643,089 | 2/1972 | Marantz | 240/78 H |
| 4,042,817 | 8/1977 | McNamara, Jr. | 240/9 R |
| 4,349,866 | 9/1982 | Molnar | 362/263 |
| 4,475,147 | 10/1984 | Kristofek | 362/148 |
| 4,517,631 | 5/1985 | Mullins | 362/346 |
| 4,519,019 | 5/1985 | Hall | 362/147 |
| 4,564,888 | 1/1986 | Lewin et al. | 362/147 |
| 4,748,543 | 5/1988 | Swarens | 362/147 |
| 4,809,147 | 2/1989 | Negishi | 362/347 |
| 4,947,292 | 8/1990 | Vlah | 362/32 |
| 4,947,305 | 8/1990 | Gunger, Jr. | 362/297 |
| 4,956,959 | 9/1990 | Goldenberg et al. | 362/297 |

OTHER PUBLICATIONS

Garcy Catalogue, Garcy Reflectors, Mirror Lighting, Nov. 22, 1939.

*Primary Examiner*—Ira S. Lazarus
*Assistant Examiner*—Y. Quach
*Attorney, Agent, or Firm*—Harvey S. Hertz; William T. O'Neil

[57] ABSTRACT

An illumination system for a vanity or the like in which a flat mirror mounted on a wall extends vertically from the vanity counter to the ceiling of a room. A recessed light source mounted in an enclosure is in juxtaposition with the mirror at the wall-to-ceiling junction over the vanity counter. An assembly of low voltage Xenon filled strip lights extends laterally within the enclosure to illuminate an arcuate reflector and is concealed from direct view by a horizontal portion of the enclosure. The enclosure has a downward facing aperture elongated according to the width of the mirror at the interface of the arcuate reflector with the mirror top edge. The mirror, light source and reflector cooperate to provide optimum vertical and horizontal plane illumination at the vanity counter and beyond.

13 Claims, 4 Drawing Sheets

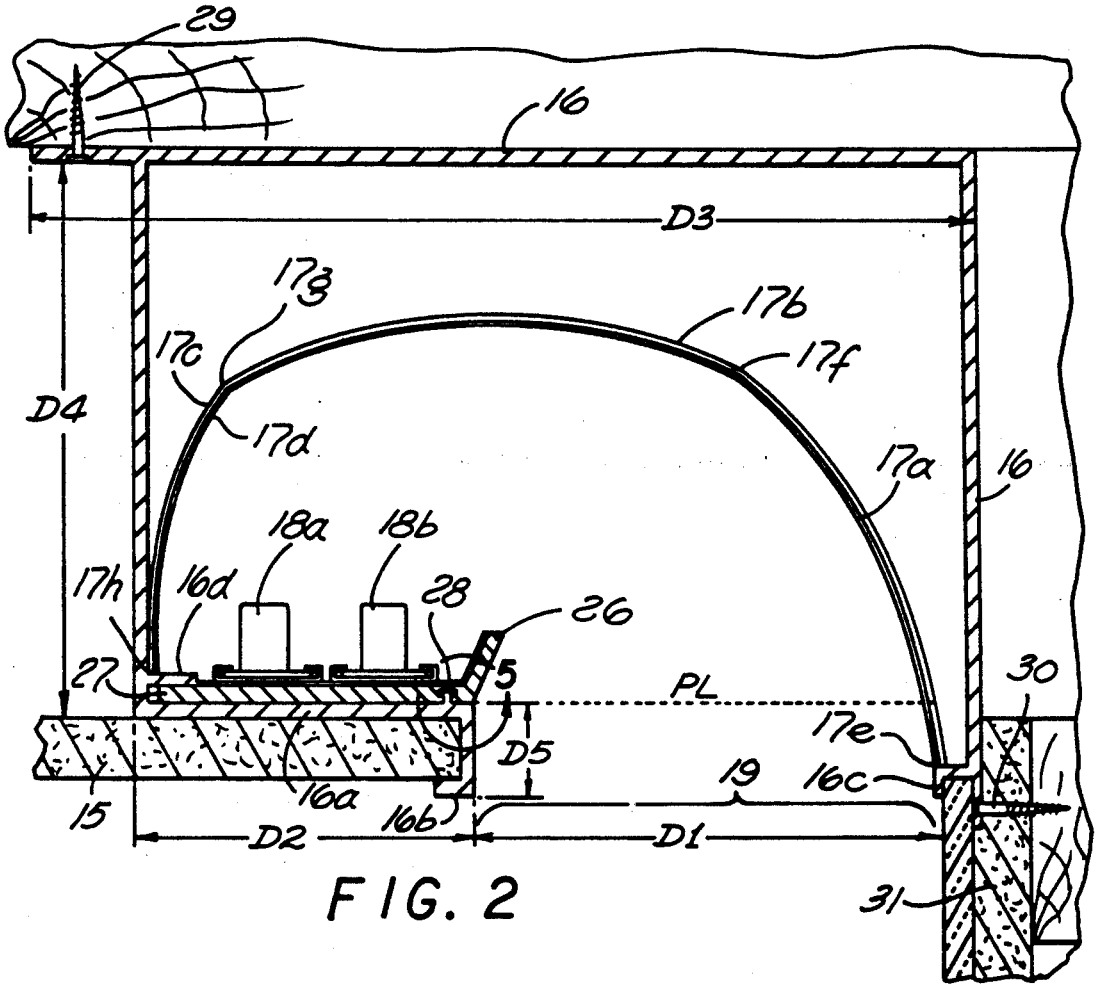
FIG. 2
FIG. 3
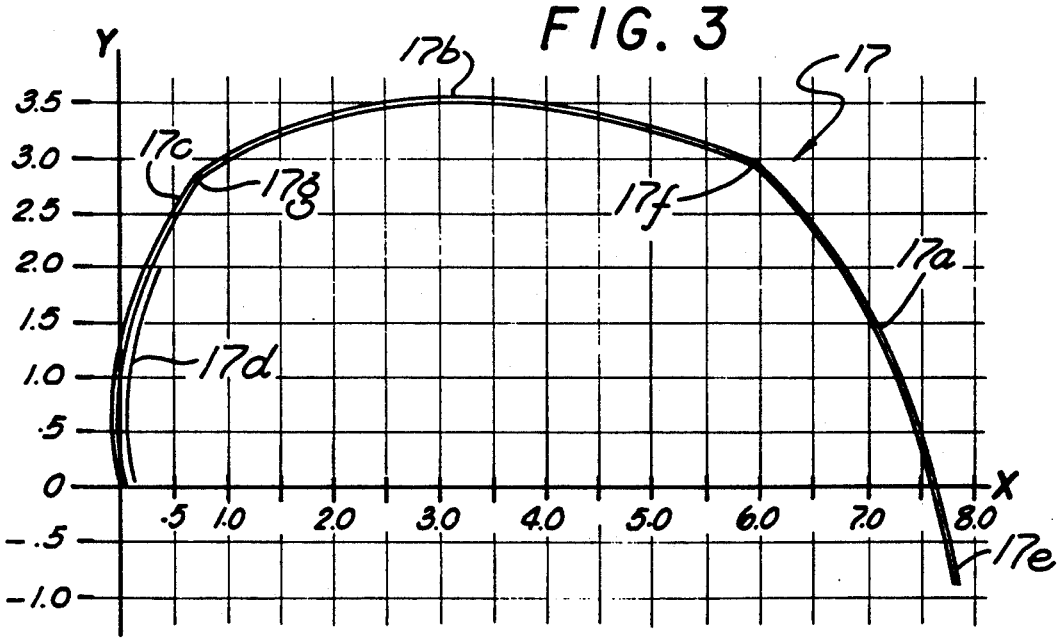

ILLUMINATION SYSTEM FOR VANITY OR THE LIKE

This application is a continuation-in-part of U.S. patent application Ser. No. 07/704,878, filed May 23, 1991 now abandoned.

BACKGROUND OF THE INVENTION

1. Field of the Invention

The invention relates generally to room interior illumination and more specifically to illumination of a vanity counter and person in proximity thereto to provide improved mirror imaging of the person.

2. Description of the Prior Art

In the prior art there have been a number of architectural illumination arrangements for special purposes. These known approaches have been based on the use of fluorescent or incandescent light sources and some have been specialized for "wall wash" effect or object illumination.

The typical prior art known to the inventor includes U.S. Pat. Nos. 4,748,543; 3,643,089; 4,519,019; 4,564,888; 4,517,631; 3,609,340; and 4,475,147. The prior art objectives include (a) "wall wash" effect, (b) light source concealment and (c) uniformity of illumination.

U.S. Pat. No. 4,748,543 (Swarens) accomplishes objective (a) and (b) but does not address the objective of vanity counter and person illumination to effect optimum person reflection in a vanity mirror, objective (d).

U.S. Pat. No. 3,643,089 (Marantz) also accomplishes objectives (a) and (b) but does not provide for objective (d).

U.S. Pat. No. 4,519,019 (Hall) accomplishes objective (b) but only partially effects objective (a) since it depends on mechanically orienting a reflector to direct illumination against a portion of a wall. Objective (c) and (d) are not effectively addressed.

U.S. Pat. No. 4,564,888 (Lewin et al) is said to be a wall-wash fixture, however it does not appear to address objective (d) although some benefit corresponding to objective (c) would appear to be obtained.

U.S. Pat. No. 4,517,631 (Mullins) obviously accomplishes objective (b) and claims to have objective (a) benefits, however objective (d) is not effected.

U.S. Pat. No. 3,609,340 (Habre) appears to accomplish objective (b), but indicates a purpose of providing a directional illumination. Other objectives do not appear to have been considered.

U.S. Pat. No. 4,475,147 (Kristofek) adds a positional "side looking" reflector surface into a conventional flush ceiling fixture to produce objective (a), however uniformity of illumination would not be accomplished for "wall wash" to any great extent.

Looking in all of the aforementioned prior art disclosures is the concept of combining a light source and specialized reflector with a vertical plane mirror surface to effect optimum illumination of a vanity bench and optimum illuminated imaging of a person standing before the vanity combination.

SUMMARY OF THE INVENTION

In consideration of the limitations of the prior art, it may be said to have been the general objective of the invention to effect optimum illumination of a vanity counter and a person standing before the vanity to produce a bright and uniform mirror image of that person.

The arrangement according to the invention includes a planar mirror in a vertical plane extending from a vanity counter upward substantially to the point of the interface with the plane of the room ceiling. A luminaire enclosure carries the light source placed to illuminate a reflector surface having three smoothly concave, downward facing reflective surfaces segments and a downward facing aperture adjacent to the top edge of the mirror. The three reflective surfaces are joined to form a single reflector having a composite empirically determined overall shape. The reflector and its enclosure are elongated corresponding to the mirror width.

Reflector material and light source spectral characteristics are selected to provide desirable illumination in the vanity application.

The light source and mirror uniquely cooperate to provide the desired illumination of a person standing before the vanity to produce a bright and spectrally correct mirror image of the person.

An alternate housing for the light source and reflective surfaces is in the form of a surface mounted unit particularly adapted for mounting over an existing wall mirror and under the adjacent ceiling is also described.

The details of the preferred embodiments according to the inventor will be presented in the description following.

BRIEF DESCRIPTION OF THE DRAWINGS

FIG. 2 is a detailed cross-sectional view of the elongated luminaire enclosure of FIG. 1.

FIG. 3 shows the detailed shape of the reflector of FIGS. 1 and 2.

DETAILED DESCRIPTION

Figure 1:
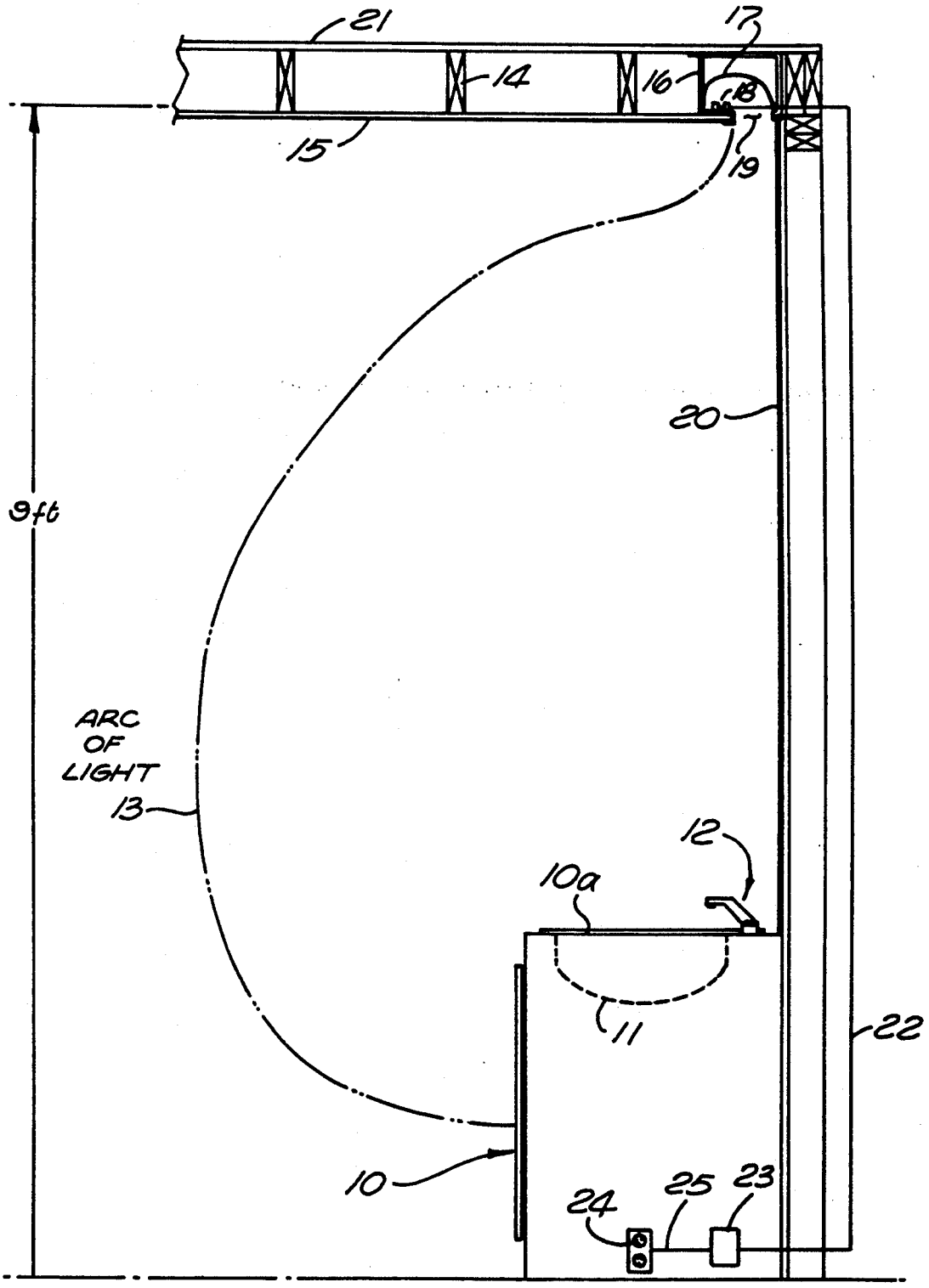
FIG. 1 is a cross-sectional view of the flush-mounted enclosure containing the light source and the mirror of the combination.

Referring now to FIG. 1, a cross-section of one portion of a room having a nine foot ceiling is shown. A typical vanity is shown generally at 10, with a lavatory 11 and faucet assembly 12. An arc of light intensity 13 is drawn to show the full face and body illumination a person standing at the vanity would receive. A typical residential ceiling structure includes ceiling joists 14, a plaster or dry wall ceiling surface 15 and the luminaire enclosure 16 housing the reflector 17 and light source 18. Downward facing aperture 19 is in close juxtaposition with mirror 20, the latter extending vertically from the vanity counter 10*a* to the aperture 19. Element 21 may be a conventional sub-floor for additional structure above, or may be roof planking, but in any event it provides a surface to which the enclosure 16 may be secured.

The combination described is obviously adapted to new construction or remodeling. Electrical wiring is of a low voltage type and is thereof adapted to "informal" wiring. Electrical leads 22 are shown along with transformer 23 which may be conventionally connected to a 115/120 volt conventional electrical convenience outlet 24 via lead 25 to provide the low voltage applied to light source 18. In new construction conventional wiring methods would be used to supply the low voltage needed by the light strips. This will be further understood as the light source is identified hereinafter.

The configuration foregoing assumes a nine foot ceiling, however the ceiling height can be varied. Some modification of the characteristics of the reflector 17 can be effected empirically to adapt the illumination characteristics to a different ceiling height, however since the objective of the illumination relates to full face and torso illumination of a person before the vanity counter, an eight foot ceiling would effect minimal modification of reflector 17. In FIG. 1, reflector 17 is represented broadly without regard to its actual shape. FIGS. 2 and 3 serve to describe the actual shape of the reflector in detail hereinafter.

Referring now also to FIG. 2, an enlarged view of the housing 16 and reflector assembly 17 is presented in cross-section consistent with FIG. 1. It will be understood that the housing 16 and reflector assembly 17 extend laterally substantially parallel to the top edge of mirror 20, preferably over the full width dimension of mirror 20. The same is true of the dual light strip assemblies 18*a* and 18*b*. These light strips will be further identified and described in connection with FIG. 4.

A removable tray 27 with a hand grip projection 26 mounts the light strips 18*a* and 18*b*. The tray 27 fits into a slot formed by projection 16*d* on housing 16 and is retained by a snap-grip arrangement at 28. Lifting of grip 26 by hand extended through aperture 19 effects disengagement of this retention means whereby the entire light strip assembly may be removed for replacement of individual lamps in the strips or other maintenance.

It will be noted that the reflector 17 comprises three smoothly curved sections 17*a*, 17*b* and 17*c* joined at inflection points 17*f* and 17*g* as illustrated in FIG. 2 to form a complex reflector shape optimized to produce a light lobe as illustrated at 13 FIG. 1.

The housing 16 is preferably but not necessarily fabricated from heat resistant white ABS plastic material. That material is readily and economically fabricated into the desired shape by conventional methods and, unlike common metallic materials, does not corrode over time, however, if other consideration dictate, housing 16 may be of the prior art metallic type.

It will also be noted that, for installation convenience, a pocket is formed under portion 16*a* of housing 16 by return 16*b*. This pocket provides for insertion of conventional dry wall ceiling board or lath board for application of a layer of plaster. Dimension D5 is whatever is consistent with that insertion.

Similarly, a pocket is formed by return 16*c* for mirror 20. This provides mirror positioning associating the mirror with the reflector surface as indicated in FIG. 2. This association is important as previously indicated, because of the synergistic effect between the reflector and the mirror in producing the desired full body and face illumination partially from reflected light from the mirror 20. Segment 17*a* extends below the plane of the aperture 19 at 17*e*. Illumination of the mirror to generate the corresponding reflected light for the purpose is largely from corresponding reflected light for the purpose is largely from segment 17*b* of the reflector. Segment 17*b* directs light received from the light strips 18*a* and 18*b* through aperture 19 onto mirror 20 and segment 17*a* transmits light directly through aperture 19.

The extension of reflector segment 17*a* below the horizontal plane (PL) associated with aperture 19 at 17*e* augments the direct face and body illumination effect.

Wood screws 29 and 30 provide typical anchoring of the housing 16 to ceiling joists 14 and wall studs 31 behind mirror 20.

The reflector segments 17*a*, 17*b* and 17*c* are fabricated as a single piece of heat resistant ABS, which has a high reflectivity and also provides the manufacturing advantages recited in connection with the housing 16. In addition, segment 17*c* may be lined over its surface between 17*h* and 17*g* with an optical grade acrylic or polycarbonate film 17*d*. These thin films are attached to the surface of segment 17*c* by a conventional adhesive and are available as items of commerce. The 3M Corporation markets such films as 3M SCOTCH TM optical lighting film #2300 and #2301, respectively. The very high reflectivity thus achieved directs light from light strips 18*a* and 18*b* toward reflector segments 17*a* and 17*b*. The aforementioned polycarbonate film has a higher threshold of heat induced distortion and therefore may be preferred in view of the heat given off from light strips 18*a* and 18*b*.

In a typical embodiment of the invention, the aperture 19 width D1 (measured outward from mirror 20) was 3¾ inches and the adjacent D2 portion (shelf) was 3 1/16 inches. The housing dimension D3 was 8¼ inches and its height D4 was 5 7/16 inches.

Referring now to FIG. 3, the shape of reflector 17 is defined on a ¼ inch grid (not illustrated to scale). From FIG. 3 it will be realized seen that the overall reflector shape 17 approximates the values given in table 1 following.

The x coordinate is taken in the horizontal plane extending from 17*h*.

The y coordinate is given with respect to that plane.

TABLE 1

| X coordinate | Y coordinate |
|---|---|
| 0 | 1.0 |
| 0.25 | 2.00 |
| 0.50 | 2.50 |
| 0.75* | 2.75* |
| 1.00 | 3.00 |
| 1.50 | 3.25 |
| 2.00 | 3.35 |
| 2.50 | 3.45 |
| 3.00 | 3.50 |
| 3.50 | 3.45 |
| 4.00 | 3.40 |
| 4.50 | 3.35 |
| 5.00 | 3.25 |
| 5.50 | 3.14 |
| 6.00* | 3.00** |
| 6.50 | 2.35 |
| 7.00 | 1.20 |
| 7.50 | 0.37 |
| 7.75 | −0.50 |
| 7.80*** | −0.87*** |

*Point 17g
**Point 17f
***Point 17e

In FIG. 3, the high reflectance film 17*d* is shown spaced slightly from reflector segment 17*c* for clarity, however it is to be understood that 17*d* is firmly attached to the surface of 17*c*.

In view of the fabrication of the reflector 17 from white ABS, a degree of flexibility is achieved. The inflection points 17*f* and 17*g* do not constitute separations but rather are fabricated directly into the overall reflector 17. For installation within housing 16 (or removal therefrom) it is only necessary to manually deflect 17*e* away from 16*c* and the reflector may be rotated downward through the aperture 19 for removal.

Figure 4:
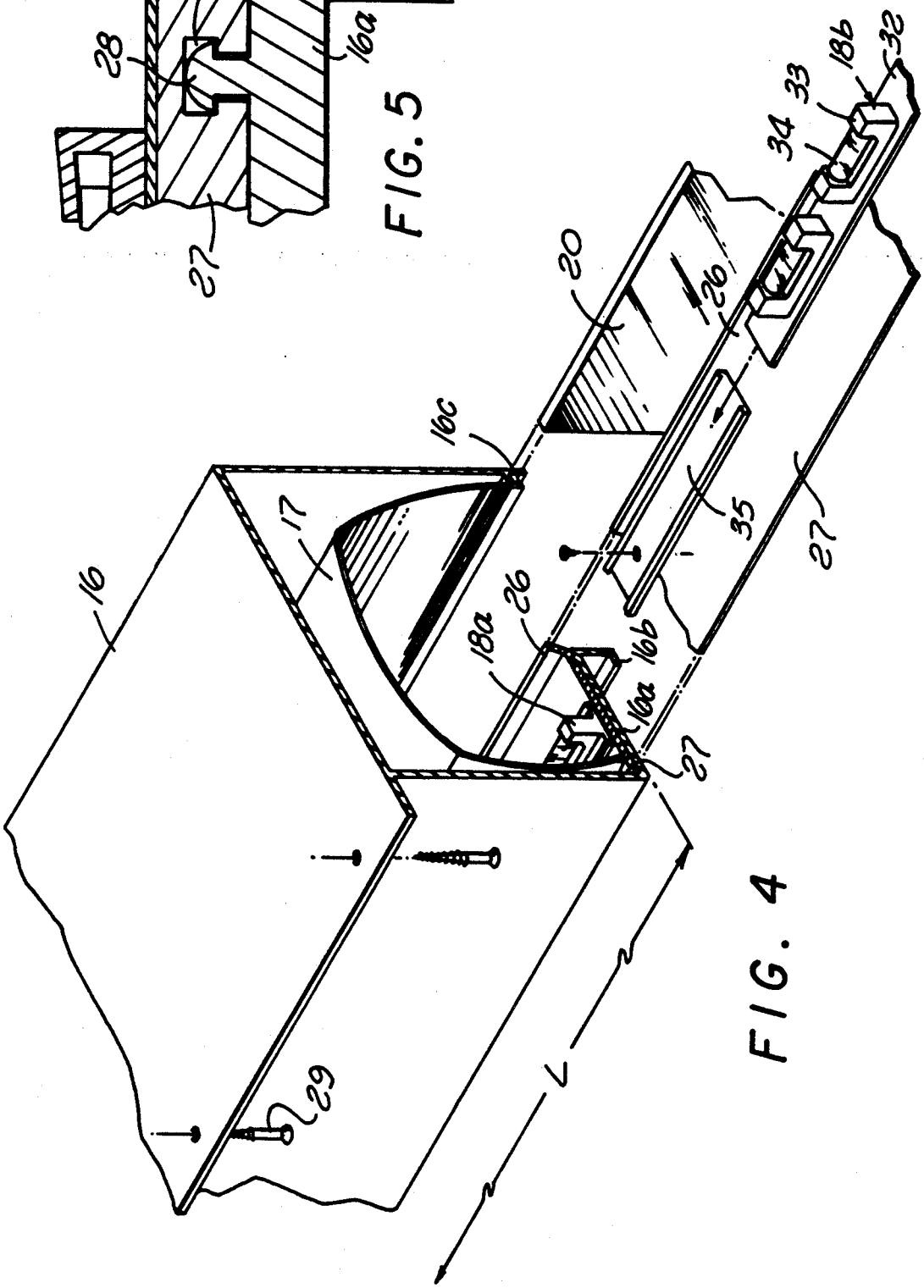
FIG. 4 is a partially exploded pictorial illustration of the elongated enclosure showing the light source location and attachment.

Referring now to FIG. 4, a partially exploded pictorial of the housing, reflector and light strip assembly is shown for clarification of the light strip installation. The light strips are items of commerce and are purchased as a unit comprising a flexible base strip 32 on which a linear plurality of individual reflective sockets, typically 33, are mounted. As purchased, the socket spacings along the strip can be varied, however for the high level of light required in the combination of the invention a maximum axial spacing of three inches was selected. The lamps are Xenon filled 10 watt axial units. It will be noted that two parallel light strips are employed. Preferrably the lamp sockets on one strip are axially staggered with respect to the other to enhance the uniformity of illumination. A track 35 typically is mounted on the tray 27 for each strip to receive the corresponding base strip 32. Mirror 20 is shown removed from its slot 16*c*, however it will be understood that the luminaire housing dimension L would normally be equal to the mirror width dimension.

Others of the elements shown in FIG. 4 are also identified in FIG. 1 and 2 and have been described hereinbefore.

Figure 5:
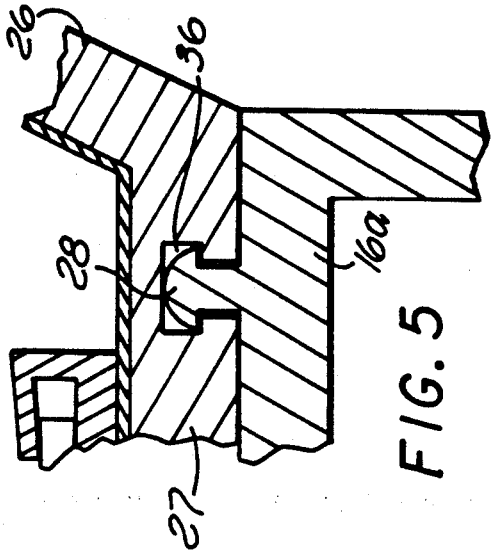
FIG. 5 is a detail illustrating the attachment of the light strip depicted in FIG. 4.

FIG. 5 shows, the attachment details as indicated in FIG. 2 for anchoring the tray 27 to portion 16*a* of the housing structure. A tee slot 36 in carrier tray 27 mates with a "bolt head" projection 28 on 16*a*. This structure could be regarded as a "slide-in" arrangement whereby carrier tray 27 is axially slid over 28 and within the slot between 16*a* and 16*d*, however since end clearance at either end of the housing 16 may be limited, and since the structural parts are of relatively flexible, white, high impact styrene, the arrangement of FIG. 5 is preferably a snap-in-place structure reached through the aperture 19. The "bolt head" projection 28 and slot 36 are exaggerated as illustrated, however such snap-in arrangements are well known as employed in the present combination.

The spectral characteristics of the optional optical film 17*d* and the emission characteristics of the Xenon filled axial lamps combine to provide superior color rendition suited to vanity illumination.

The strip light assemblies 18*a* and 18*b* and transformer 23 to provide the required 241 volt supply may be as manufactured and sold by Starfire Lighting of Jersey City, N.J. The flexible strips 32 on which the reflective light sockets are mounted have integral conductors embedded therein to connect the individual sockets to the 12 volt supply.

Figure 6:
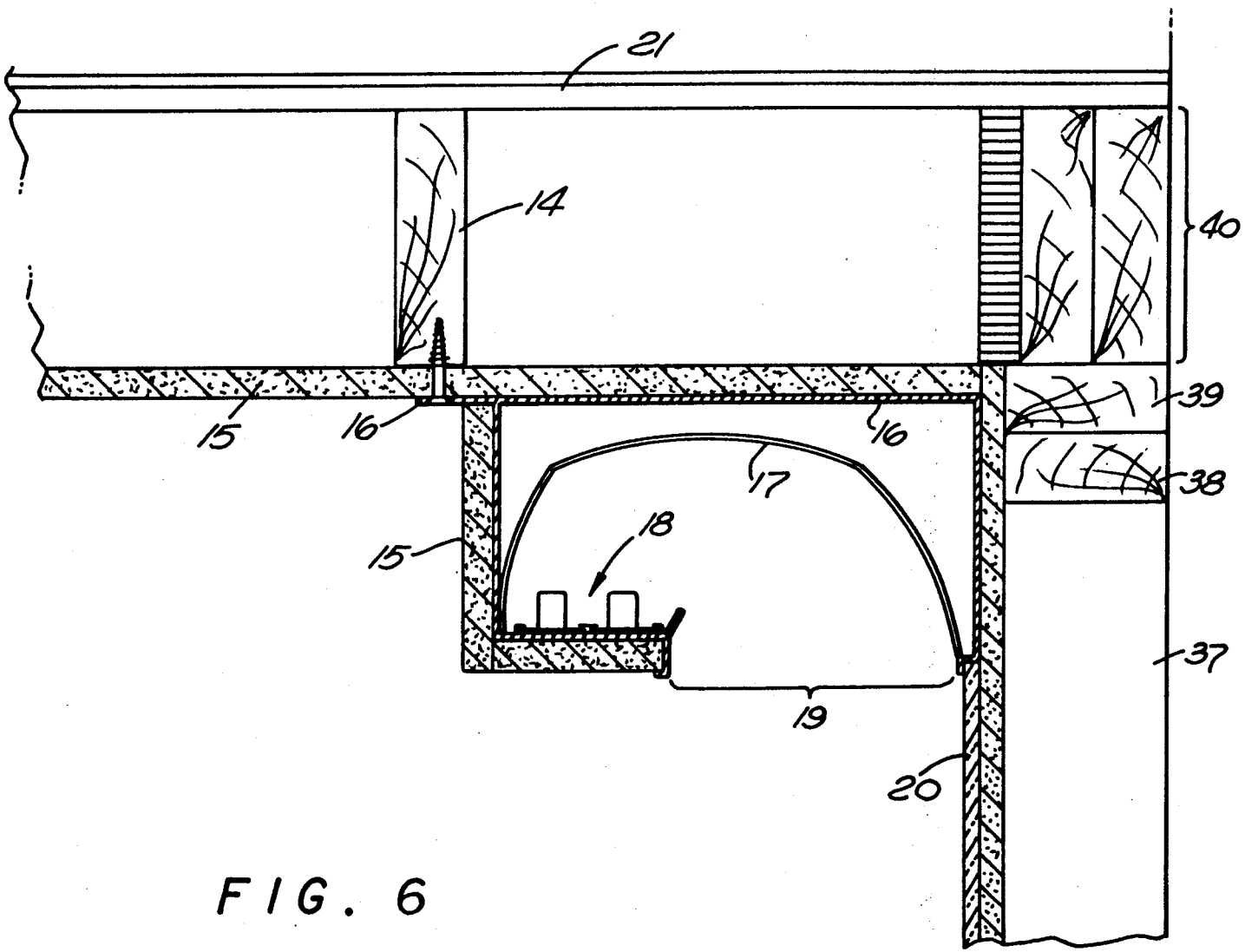
FIG. 6 is a cross-sectional view of the alternative surface-mounted version of the enclosure of FIG. 1.

One variation particularly useful for post construction installation is shown in FIG. 6. Here the enclosure 16 is mounted between the ceiling 15 and the mirror 20, it being assured that the mirror is mounted on wall structure 31 and extends upward to the ceiling intersection. The structure of the enclosure 16 can be mounted to ceiling 15 at joints within the interface of enclosure 16 and ceiling 15 . A portion of the enclosure overlapping the top portion of mirror 20. The bottom panel of enclosure 16 thereby becomes the substantially horizontal surface corresponding to ceiling 15 in FIG. 1 and the junction of mirror 20 and aperture 19 is equivalent to point 16*c* on FIG. 2.

Of course, if the mirror 20 does not extend as far upward as the ceiling 15, the point 16*c* can be as shown in FIG. 2.

The variation according to FIG. 6 affords the opportunity for post construction installation and may be covered with drywall 15*a* as shown or the inclosure 16 may simply be permitted to show without the drywall treatment.

The elements 17 and 18 in FIG. 6 are identical with those shown in FIG. 2 as are the details of the segmented reflector 17 as described. The wall studs 37 with plates 38 and 39 and also rim joint and blocking structure 40 are shown as typical construction not related to the level structure. Typical floor joint 14 and floor above construction 21 are likewise typical construction only.

The light coverage (slot) 18 is intended to be identical with that shown on FIG. 1, FIG. 2, and FIG. 4, although it should be realized that the multiple axial lamp arrangement could be changed to an elongated fluorscent tube arrangement while retaining the system advantage achieved by illuminator/reflector combination.

Various modifications to the structure are obviously possible and will suggest themselves to the skilled reader. Accordingly it is not intended that the scope of the invention be regarded as limited by the specifics of the drawing or this description, these being typical and illustrative only.

We claim:

1. An illumination system for a vanity or the like, comprising:

a counter and a mirror associated with said vanity, said mirror being mounted in a substantially vertical plane between said counter and a ceiling of a room in which said vanity is located;

a flush lighting fixture comprising an enclosure mounted into said ceiling, said enclosure having an elongated aperture adjacent to the top of said mirror and extending over at least a portion of the width of said mirror;

an elongated and substantially rectangular aperture in a plane of said ceiling, said elongated and substantially rectangular aperture opening into said enclosure and extending adjacent to the top edge of said mirror along at least a portion of the width of said mirror;

a linear light source extending substantially parallel to said aperture within said enclosure; and a concave reflector responsive to light emission from said linear light source within said enclosure, said reflector having first, second and third surfaces, said first surface being oriented to reflect said light emission laterally toward said second and third surfaces, said second surface, being oriented to reflect light generally downward through said elongated and substantially rectangular aperture and toward said mirror, said third surface being oriented to reflect light downward through said elongated and substantially rectangular aperture and into said room adjacent said counter, said second and third reflector surfaces being illuminated directly from said linear light source and by reflection form said first surface 2. The illumination system according to claim 1 in which said enclosure and said elongated and substantially rectangular aperture therein are elongated over substantially the entire width of said mirror.

3. The illumination system according to claim 2 in which the width of said elongated and substantially rectangular aperture measured normal to said mirror is less than the width of said enclosure measured normal to said mirror thereby producing a horizontal interior shelf within said enclosure, said linear light source being mounted on said substantially horizontal interior shelf.

4. The illumination system to claim 3 in which said linear light source comprises at least one elongated strip having an axial series of Xenon-filled incandescent lamps.

5. The illumination system according to claim 4 in which said linear light source comprises two substantially parallel strips each of low voltage, low wattage, Xenon axial lamps electrically connected in parallel.

6. The illumination system according to claim 3 in which said concave reflector is fabricated as a unit including said three reflector surfaces from heat resistant white PVC and said first reflector surface includes an overlay of optical grade lighting film having high reflectivity thereby to enhance, the illumination of said second and third reflector surface from said first surface.

7. The illumination system according to claim 3 in which the edge of said third reflector surface adjacent said mirror projects downward below a plane of said horizontal interior shelf.

8. The illumination system according to claim 1 in which the width of said elongated and substantially rectangular aperture measured normal to said mirror is less than the width of said enclosure measured normal to said mirror thereby producing a substantially horizontal interior shelf within said enclosure, said linear light source being mounted on said substantially horizontal interior shelf.

9. The illumination system according to claim 8 in which said linear light source comprises at least one elongated strip having a lengthwise series of Xenon-filled incandescent lamps.

10. The illumination system according to claim 8 in which the edge of said third reflector surface adjacent said mirror projects downward below a plane of said substantially horizontal interior shelf.

11. The illumination system according to claim 1 in which said concave reflector is fabricated as a unit including said three reflector surfaces from heat resistant white PVC and said first reflector surface includes an overlay of optical grade lighting film having high reflectivity thereby to enhance the illumination of said second and third reflector surface from said first surface.

12. A vanity illumination system for effecting improved face and body illumination of a person adjacent to said vanity, comprising:

a mirror mounted on a wall of a room in which said vanity is located, said mirror extending from a counter of said vanity to a ceiling line of said room;

a ceiling flush lighting fixture having a substantially rectangular aperture adjacent to a top edge of said mirror, said ceiling flush lighting fixture including an enclosure recessed into a ceiling; and means comprising a multi-surface concave reflector within said enclosure, said enclosure and said substantially rectangular aperture being elongated parallel to a plane of said mirror, and a linear array of axial Xenon-filled incandescent lamps extending substantially parallel to the plane of said mirror, the multi-surface of said concave reflector being oriented to direct light from said linear array of axial Xenon-filled incandescent lamps downward at an angle toward said mirror, backward toward said person located at said vanity counter and downward toward said vanity counter, said ceiling flush lighting fixture and said mirror cooperating to provide said face and body illumination and a bright mirror image of said person.

13. An illumination system for a vanity or the like, comprising:

a counter and a mirror associated therewith, said mirror being mounted in a vertical plane on a wall adjacent said counter;

a lighting fixture comprising an enclosure mounted on a ceiling over said counter, said enclosure abutting said mirror at the point of intersection of an enclosure bottom surface and said mirror, said enclosure bottom surface having an elongated and substantially rectangular aperture adjacent said point of intersection, said elongated and substantially rectangular aperture opening into said enclosure and extending adjacent to the surface of said mirror over at least a portion of the width of said mirror; a linear light source extending substantially parallel to said elongated and substantially rectangular aperture within said enclosure; and a concave reflector within said enclosure responsive to light emission from said linear light source; said concave reflector having first, second and third surfaces, said first surface being oriented to reflect light laterally toward said second and third surfaces, said second surface being oriented to reflect light generally downward through said elongated and substantially rectangular aperture and toward said mirror, said third surface being oriented to reflect light downward through said elongated and substantially rectangular aperture and into the room adjacent said counter, said second and third reflector surfaces being illuminated directly from said linear light source and by reflection from said first surface.

* * * * *